US005752559A

United States Patent [19]

Minow

[11] Patent Number: 5,752,559

[45] Date of Patent: May 19, 1998

[54] WIRE GATE CONTROL APPARATUS

[76] Inventor: Darrel J. Minow, HC57, Box 4090-1, Sidney, Mont. 59270

[21] Appl. No.: 779,384

[22] Filed: Jan. 7, 1997

[51] Int. Cl.[6] ..... E01F 13/04

[52] U.S. Cl. ..... 160/328; 49/34

[58] Field of Search ..... 160/328, 327, 160/329, 332, 188, 189; 49/34; 256/37, 39

[56] References Cited

U.S. PATENT DOCUMENTS

| | | | |
|---|---|---|---|
| 1,642,875 | 9/1927 | Fitch et al. | 160/328 |
| 2,109,300 | 2/1938 | Mortensen | 160/328 |
| 3,825,053 | 7/1974 | Romberg | 160/328 |
| 3,845,804 | 11/1974 | Romberg | 160/328 |
| 4,509,577 | 4/1985 | Priefert | 160/328 |

*Primary Examiner*—David M. Purol

*Attorney, Agent, or Firm*—David A. Lingbeck

[57] ABSTRACT

A wire gate control apparatus includes a base sleeve having an aperture near the top thereof and a longitudinal slot at the bottom thereof and further having a keeper biasedly mounted at the aperture, and further includes a plunger slidably disposed within the sleeve and having first and second apertures spaced apart and a horizontal slot disposed between the first and second apertures and adapted to engage the keeper to lock the plunger in predetermined place and having a detent adapted to slide within the longitudinal slot, and also includes an arm pivotally mounted near its bottom to a pair of brackets fixedly attached to the sleeve, and having wire-connecting member spaced along the length thereof. The detent contacts the arm to close the wire gate and moves out of contact with the arm to lower the arm and open the wire gate. Preferably, a loader mounted to a tractor forces the plunger downwardly to open and closed the wire gate without the user ever having to manually open and close the gate with one's own hands.

16 Claims, 3 Drawing Sheets

WIRE GATE CONTROL APPARATUS

BACKGROUND OF THE INVENTION

This invention relates to a wire gate control apparatus which allows the user to open and lay down a wire gate and also to lift and close the wire gate without the user ever having to alight from a tractor having a loader thereon. The user positions the loader over the wire gate control apparatus and lowers the loader onto an element of the wire gate control apparatus to actuate the opening and closing of the wire gate.

Before the present invention, wire gates generally comprise separate wires fixedly attached to a first corner post aligned with the fence line, the separate wires having ends which are wrapped around or fastened with U-shaped nails to the first corner post, the separate wires being spaced along the length or height of the corner posts which is disposed upright. The other ends of the separate wires are wrapped around or nailed to a support post, the separate wires being generally parallel to each other. To close the wire gate, the user positions the support post upright next to a second corner post separated from the first corner post with the space in between being the passage through the fence, and is securely held in place with a wire loop which is placed over the top ends of both the support post and the second corner post. The separate wires extending between the two corner posts form the gate through which the user uses to pass through the fence. To open the wire gate prior to this invention, the user lifts the wire loop off the support post and either lets the support post and separate wire drop to the ground or moves the supports post and separate wires away from the passage and then lets down the support post and separate wires to the ground.

Wire gates are not like gates made of iron or steel where in order to open or close them, the user needs to only swing the gates about their pivots. Instead of the user having to physically open and close the wire gate by hand, the present invention allows the user to mechanically open and close the wire gate with preferably the aid of a loader mounted to a tractor.

SUMMARY OF THE INVENTION

The present invention relates to a wire gate control apparatus which comprises a base sleeve which is bolted to a fence corner post and which has an aperture through the wall of one side near the top thereof and has a longitudinal slot through the wall of the same side near the bottom thereof and which has a keeper biasedly and pivotally disposed through the aperture. A plunger is slidably mounted inside the sleeve through the top thereof and has a first aperture through a wall of the plunger near the top thereof, a slot through the wall of the plunger and spaced below the first aperture, and a second aperture through the wall of the plunger and spaced below the slot and further has a detent at the bottom thereof and adapted to move vertically within the longitudinal slot to release and lift an arm which is pivotally attached to a pair of brackets which are welded to near the bottom of the sleeve. The arm has a plurality of wire retainer members spaced along the length thereof to which the wire forming the gate is attached. A loader mounted to a tractor is used to move the plunger down to release the arm which swings downwardly to the ground to lay the wire gate upon the ground and to allow the tractor to pass through the gate opening. To close the wire gate, the loader is again used to move the plunger down which lifts the arm and closes the wire gate.

One objective of the present invention is to provide a wire gate control apparatus which allows the user to open and close a wire gate without ever having to alight from a tractor which not only saves time but also eliminates the user having to be confronted with bad weather such as cold and snow.

Another objective of the present invention is to provide a wire gate control apparatus which conveniently and easily opens and closes by means of a loader mounted to a tractor.

Yet, another objective of the present invention is to provide a wire gate control apparatus which lays the wire down such that the wires forming the gate do not become entangled which would make it difficult to re-close the wire gate.

Further objectives and advantages of the present invention will become apparent as the description proceeds and when taken in conjunction with the accompanying drawings wherein:

DETAILED DESCRIPTION OF THE INVENTION

Figure 1:
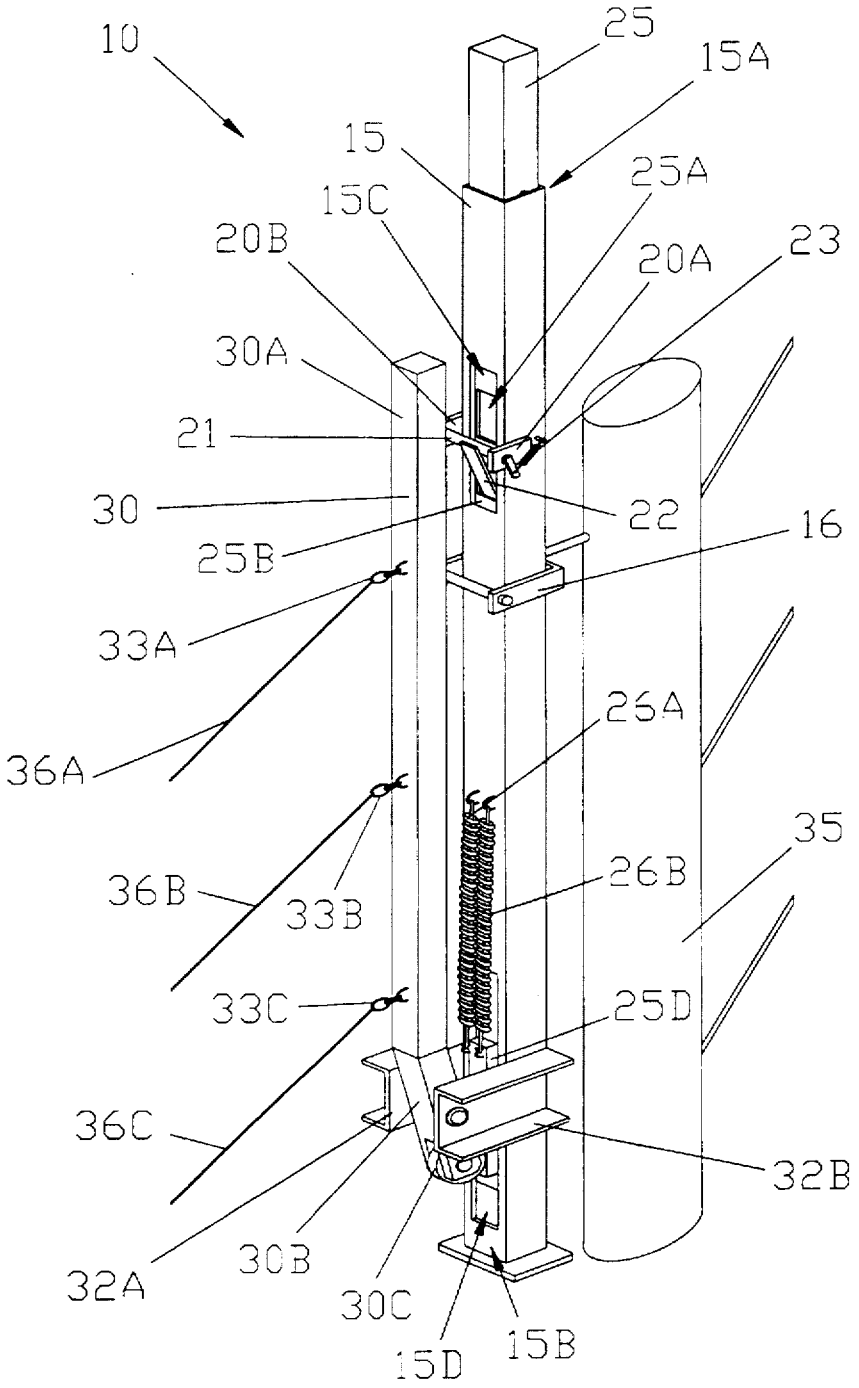
FIG. 1 is a front perspective view of the wire gate control apparatus attached to a corner post with the wires being attached to the arm which is raised in a closed position.

Referring to the drawings in FIGS. 1–4, in particular, the wire gate control apparatus 10 comprises a base sleeve 15 having an aperture 15C through the wall near the top 15A thereof, the aperture 15C being to one side of the base sleeve 15 and being adapted to receive a keeper which is pivotally disposed upon the aperture 15C and which includes a spindle 21 journaled to two brackets 20A–B which are fixedly attached or welded to the wall of the base sleeve 15 on either side of the aperture 15C, the keeper also including a planar tongue member 22 which is welded to and perpendicularly extends from the spindle 21 and which pivotally extends inside the base sleeve 15 through the aperture 15C, the keeper also having a spring member 23 which is connected to the base sleeve 15 and to a portion of the spindle 21 and which biases the tongue member 22 generally perpendicular to the base sleeve 15 which also has a longitudinal slot 15D extending upwardly a selected distance from near the bottom 15B of the base sleeve 15 which is disposed upright and which is bolted to a corner post 35 with a mounting bracket 16 which includes a fastening member for securely mounting or fastening the mounting bracket 16 about the base sleeve 15 and which further includes a threaded member which extends outwardly from the mounting bracket 16 through the corner post 35 and securely attaches the base sleeve 15 to the corner post 35, the mounting bracket 16 being adjustable along the length of the base sleeve 15.

Figure 2:
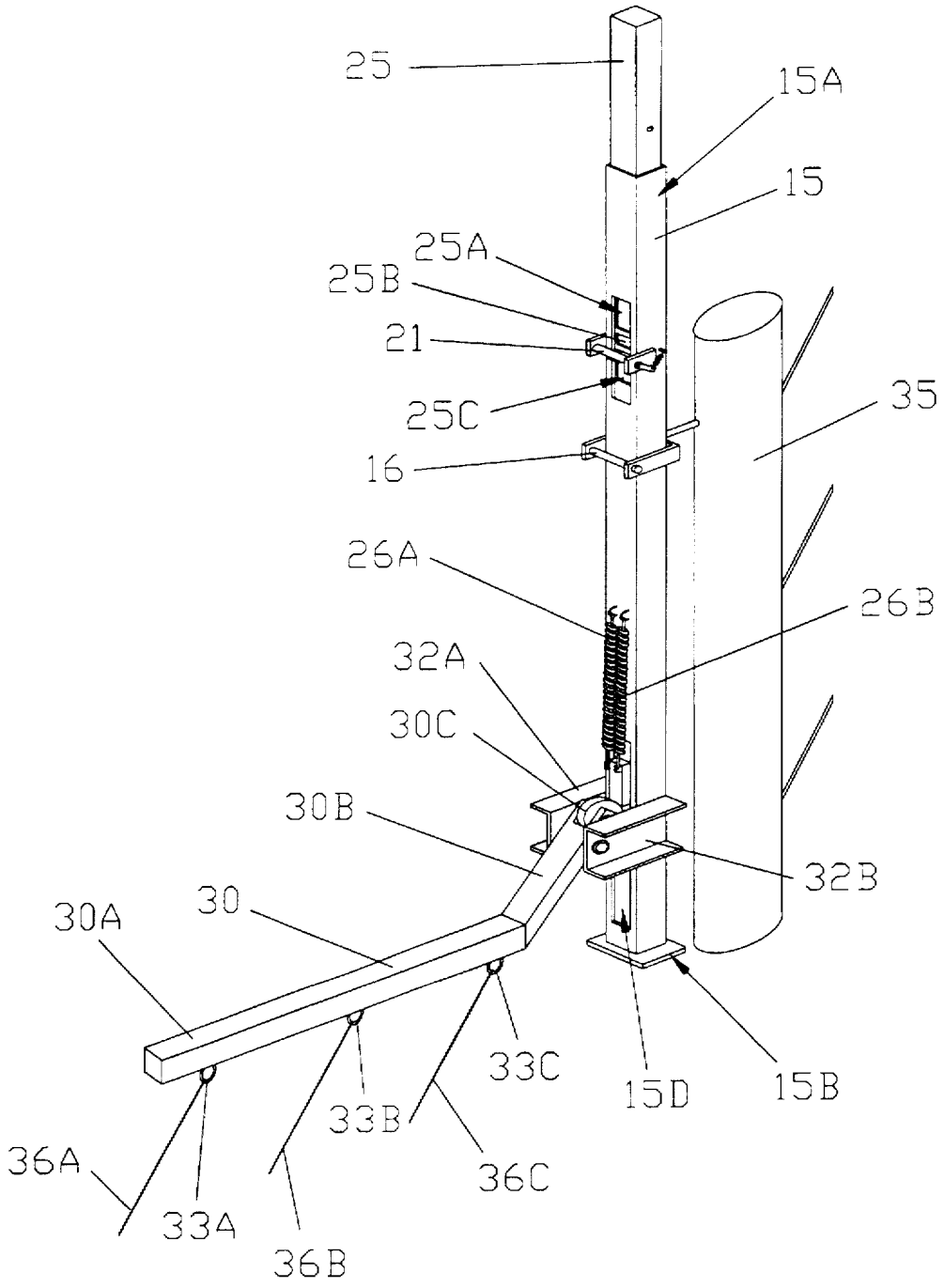
FIG. 2 is a front perspective view of the wire gate control apparatus attached to a corner post with wires being attached to the arm which is lowered in an open position.
Figure 4:
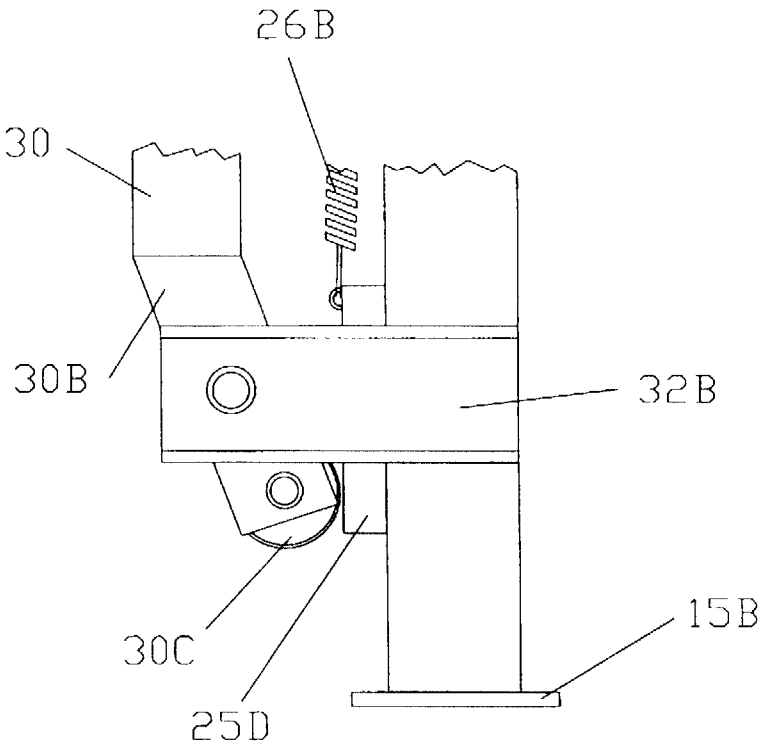
FIG. 4 is a detailed view of the bottom portion of the sleeve and of the plunger of the wire gate control apparatus, in particular the block which engages or contacts the detent-engaging member at the bottom of the arm, which releases the arm and also lifts the arm to an upright position.
Figure 3:
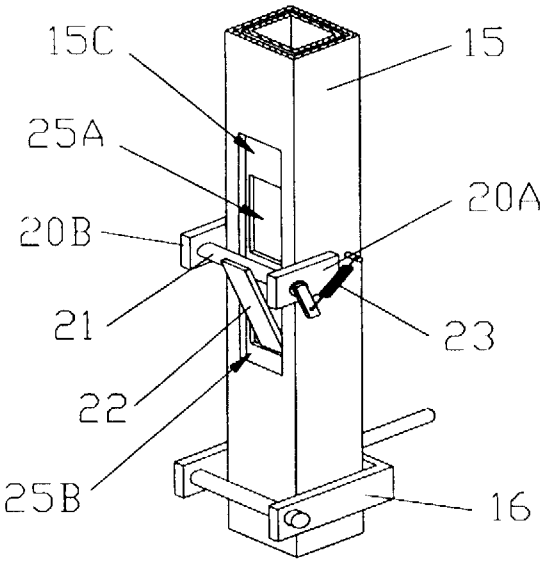
FIG. 3 is a detailed view of the keeper which is spring-loaded flipper which locks and releases the plunger, the detail view also including the top portion of the sleeve and of the plunger of the wire gate control apparatus.

As illustrated in FIGS. 1 & 2, a plunger 25 having a length essentially longer than that of the base sleeve 15 is slidably disposed through the top 15A of the base sleeve 15, the plunger 25 also having a first aperture 25A through the wall near the top thereof, the first aperture 25A being accessible through the aperture 15C of the base sleeve 15 and also being adapted to receive the tongue member 22 of the keeper. In addition, the plunger 25 also has a generally horizontal slot 25B through the wall thereof, the horizontal slot 25B being spaced and disposed below the first aperture 25A and being adapted to engage the end portion of the tongue member 22 to releasably lock the plunger 25 inside the base sleeve 15. Also, the plunger 25 has a second aperture 25C through its wall spaced below the horizontal slot 25B and being in vertical alignment to the first aperture 25A. Like the first aperture 25A, the second aperture 25C is adapted to receive the tongue member 22 of the keeper as the plunger 25 is moved vertically within the base sleeve 15. Further, the plunger 25 has a detent 25D fixedly attached or welded on the exterior of and extending outwardly from the wall near the bottom of the plunger 25, the detent 25D being adapted to slide vertically within the longitudinal slot 15D of the base sleeve 15. A pair of springs 26A–B are conventionally connected to the detent 25D and to a grommet fixedly attached to the exterior of the base sleeve 15, each spring 25A–B having an end connected through a hole in the detent 25D and having another end connected through the eye of the grommet which is fixedly disposed at a middle portion of the base sleeve 15, both springs 26A–B upwardly biasing the detent 25D and the plunger 25.

As shown in FIGS. 1 & 2, an arm 30 having a bottom 30C and a top 30A and further having an angled bottom portion 30B is pivotally attached near the bottom 30C thereof with a bolt which is attached to a pair of brackets 32A–B which are fixedly attached or welded to near the bottom 15B of the base sleeve 15, the bottom portion 30B being slightly angled relative to the rest of the arm 30 which is lockable in a generally upright position to close the wire gate and is releasable in a generally horizontal position with much of the arm 30 resting upon the ground. The arm 30 further has a detent-contacting member attached to the bottom 30C thereof against which the detent 25D engages and the arm 30 is lifted from an open horizontal position to a closed upright position. Also, three wire-connecting members 33A–C are spaced along the length of the arm 30 and on the side of the arm 30 facing away from the base sleeve 15, the wire-connecting members 33A–C essentially being bolts having an eyelet head to which chain links are connected. The wires 36A–C forming the gate are extended and connected to the chain links of the wire-connecting members 33A–C.

In a closed position, the arm 30 is locked in an upright position with the tongue member 22 of the keeper engaged in the horizontal slot 25B of the plunger 25 to prevent the plunger 25 from moving within the base sleeve 15 and from releasing the arm 30 which is held in an upright closed position by the detent 25D which is in contactable relationship to the bottom 30C of the arm 30. To open the wire gate, the user preferably uses a loader mounted to a tractor. The user moves the tractor up to the wire gate control apparatus 10 and positions the loader above the plunger 25 and lowers the loader onto the top end of the plunger 25 and then moves the loader downwardly which moves the plunger 25 downwardly which disengages the tongue member 22 from the horizontal slot 25B in the plunger 25. As the plunger 25 is moved downwardly, the tongue member 22 is directed in a downward position by the wall of the plunger 25, but upon reaching the first aperture 25A in the plunger 25, the tongue member 22 springs upwardly in a generally horizontal reset position and is extended through the first aperture 25A. Upon the tongue member 22 being reset in the first aperture 25A, the user raises the loader off the plunger 25 which allows the plunger 25 to move upwardly as far as the detent 25D can move within the longitudinal slot 15D in the base sleeve 15, because the two springs 26A–B are urging the plunger 25 upwardly, thus releasing the arm 30 which because of the angled bottom portion 30B and the weight of the gate wires 36A–C attached thereto, pivots and falls upon the ground along with the gate wires 36A–C, thus allowing the user to pass through the opening in the fence. The wire gate control apparatus 10 is arranged such that when the arm 30 drops down to the ground, it will drop down at approximately 45 degrees relative to the fence line so that the gate wires 36A–C don't become entangled.

To close the wire gate, the user again sets the loader upon the plunger 25 and again lowers the loader to urge the plunger 25 downwardly within the base sleeve 15 until the tongue member 22 reaches and extends through the second aperture 25B and then slowly raises the loader which allows the plunger 25 to also rise because of the compression springs 26A–B. As the plunger 25 moves upwardly, the tongue member 22 is directed downwardly and, upon the tongue member 22 coming into contact with the horizontal slot 25B in the plunger 25, the tongue member 22 engages the horizontal slot 22 in the plunger 25 to essentially lock the plunger 25 and the detent 25D at a stationary position. While the plunger 25 was being urged downwardly by the loader, the detent 25D was engaging the detent-contacting member at the bottom 30C of the arm 30 and was lifting the arm 30 from its horizontal position to its vertical position, resulting in the gate wires 36A–C also being raised and extended across the opening through the fence to close the gate. Of course, the user doesn't have to use a loader to open and close the wire gate, the user may use any suitable object including one's own hands.

Various changes and departures may be made to the invention without departing from the spirit and scope thereof. Accordingly, it is not intended that the invention be limited to that specifically described in the specification or as illustrated in the drawings but only as set forth in the claims.

What is claimed is:

1. A wire gate control apparatus comprising:

a base sleeve mounted upright and fastened to a corner post;

a plunger upwardly biased and slidable within said base sleeve, said plunger also being lockable at a selected position within said base sleeve for keeping said wire gate closed;

a keeper mounted to said base sleeve and engageable to said plunger for locking said plunger within said base sleeve;

an arm pivotally mounted to said base sleeve and having a plurality of wires of said wire gate being connected thereto, said arm being pivotable between an upright closed position where said wire gate is closed and an opened position where said wire gate is opened; and a detent mounted to said plunger and being contactable to said arm for lifting and holding said arm in an upright closed position.

2. A wire gate control apparatus as described in claim 1, wherein said base sleeve has an aperture through a top portion thereof and a longitudinal slot through a bottom portion thereof.

3. A wire gate control apparatus as described in claim 2, wherein said plunger has a slot through a wall thereof.

4. A wire gate control apparatus as described in claim 3, wherein said keeper is pivotally and biasedly disposed through said aperture of said base sleeve.

5. A wire gate control apparatus as described in claim 4, wherein said keeper includes a pivotally biased spindle, and a tongue member fixedly attached to and extending outwardly from said spindle, said tongue member being biasedly extendable through said aperture of said base sleeve.

6. A wire gate control apparatus as described in claim 5, wherein said tongue member is engageable in said slot of said plunger for essentially locking said plunger within said base sleeve at a position which essentially keeps said wire gate closed.

7. A wire gate control apparatus as described in claim 6, wherein said plunger also has a first aperture extending through said wall thereof and being spaced above said slot in said plunger, said first aperture being adapted for taking said tongue member out of a plunger locking position.

8. A wire gate control apparatus as described in claim 7, wherein said plunger further has a second aperture extending through said wall thereof and being spaced below said slot in said plunger, said second aperture being adapted for resetting said tongue member in said plunger locking position.

9. A wire gate control apparatus as described in claim 8, wherein said plunger is adapted to move within said base sleeve such that an object is used to urge said plunger downwardly within said base sleeve, said object being moved down upon a top of said plunger, at least one spring being used to biasedly urge said plunger upwardly within said base sleeve.

10. A wire gate control apparatus as described in claim 9, wherein said first and second apertures and said slot in said plunger are disposed in said plunger such that said apertures and said slot are moved to and away from said keeper as said plunger is moved within said base sleeve.

11. A wire gate control apparatus as described in claim 2, wherein said detent is fixedly attached near a bottom of said plunger and is slidably disposed within said longitudinal slot of said base sleeve, said detent being contactable to a bottom portion of said arm for lifting and holding said arm in said upright closed position.

12. A wire gate control apparatus as described in claim 11, wherein said detent is upwardly biased in a noncontactable relationship with said arm such that if said plunger is not locked within said base sleeve, said detent is biased upwardly out of contact with said arm.

13. A wire gate control apparatus as described in claim 12, wherein said arm is pivotally mounted near a bottom thereof to a mounting bracket which is fixedly attached to said base sleeve, said arm being pivotable between said upright closed position and said opened position; wherein said opened position includes said arm being in a relatively horizontal position with at least a top portion thereof resting upon the ground.

14. A wire gate control apparatus as described in claim 13, wherein said arm is structured and mounted to said mounting bracket such that said arm opens to a relatively horizontal position upon the ground to open said wire gate upon said detent being biased out of contactable relationship with said arm.

15. A wire gate control apparatus as described in claim 14, wherein said detent is contactable to said arm below where said arm is pivotally mounted to said mounting bracket.

16. A wire gate control apparatus as described in claim 14, wherein said base sleeve is fixedly mounted to said corner post such that said arm opens horizontally at an angle of approximately 45 degrees relative to a fence line so that said wires connected to said arm and forming said wire gate do not become entangled when opened.

* * * * *